US005775067A

United States Patent [19]

Hawley

[11] Patent Number: 5,775,067

[45] Date of Patent: Jul. 7, 1998

[54] ARTICLE SELECTOR WEDGE

[75] Inventor: Cory E. Hawley, Aitkin, Minn.

[73] Assignee: Riverwood International Corporation, Atlanta, Ga.

[21] Appl. No.: 780,645

[22] Filed: Jan. 8, 1997

[51] Int. Cl.[6] ..... B65B 35/30

[52] U.S. Cl. ..... 53/543; 53/251; 53/534; 198/418.2; 198/419.3

[58] Field of Search ..... 198/418.1, 418.2, 198/419.2, 419.3, 426, 431, 432, 433; 53/251, 252, 534, 543, 566

[56] References Cited

U.S. PATENT DOCUMENTS

| | | | |
|---|---|---|---|
| 3,332,199 | 7/1967 | Wong | 198/418.1 X |
| 3,377,774 | 4/1968 | Nigrelli | 53/534 X |
| 3,417,540 | 12/1968 | Copping et al. | 198/419.3 X |
| 4,093,063 | 6/1978 | Calvert et al. | 198/419.3 X |
| 4,237,673 | 12/1980 | Calvert et al. | 53/251 X |
| 4,389,832 | 6/1983 | Calvert | 53/251 X |
| 4,566,248 | 1/1986 | Cooley | 53/543 X |
| 4,756,139 | 7/1988 | Le Bras | 53/443 X |
| 5,103,627 | 4/1992 | Stadele et al. | 198/419.3 X |
| 5,348,135 | 9/1994 | Fulkerson et al. | 198/419.3 |
| 5,477,655 | 12/1995 | Hawley | 53/566 X |

*Primary Examiner*—Daniel Moon
*Attorney, Agent, or Firm*—Skinner And Associates

[57] ABSTRACT

A wedge for selecting articles to group on a cartoning machine where a wedge face that reacts infeed pressure has an outwardly curved surface. The curved face greatly reduces damage from infeed pressure to thin-walled cylindrical articles, such as beverage cans. In the preferred embodiment, the selector wedge is designed to attach to a flight bar on a selecting system of the cartoning machine. It has a recess to accept an end of a flight bar and holes through it for bolting the wedge to the flight bar.

18 Claims, 3 Drawing Sheets

ARTICLE SELECTOR WEDGE

BACKGROUND OF THE INVENTION

1. Field of the Invention.

The present invention relates, generally, to packaging apparatus. More particularly, the invention relates to devices used to select and separate, or meter, groups of articles at the infeed end of a cartoning machine. Specifically the invention relates to a wedge end for a flight bar used to separate groups of articles, such as b ever age cans on a cartoning machine.

2. Background Information.

On a typical packaging machine, an ungrouped stream or line of tightly packed infeed articles move in lanes on an infeed conveyor to a location where a selection or metering mechanism processes them into group s having a predetermined size and orientation. For processing articles, such as beverage cans, on a continuous motion machine, th e selection and separation of groups of cans is often done by inserting a flight bar between cans. A conveyor carries a series of flight bars generally in the same direction as the infeed conveyer. The leading end of the flight bar has a wedge shape to facilitate it passing between the cylindrical cans as it works its way through the stack of infeed cans. To keep the cans tightly stacked in lanes before being grouped, the infeed conveyer moves faster than the conveyer with flight bars. This creates pressure on the cans in the grouping area. When a selector wedge contacts a can, the infeed pressure of all the cans in that lane is exerted against that selector wedge. Prior art wedges have planar surfaces which contact the cans. Sometimes the infeed pressure is so great that it causes the cans which contact the wedge to dent or crease where they contact the wedge. Packages with such dented or creased cans are rejected and, therefore, costly to the packaging process.

Despite the need in the art for a can selector wedge which overcomes the disadvantages, shortcomings and limitations of the prior art, none insofar as is known has been developed. Accordingly, it is an object of the present invention to provide an improved can selector wedge for use with a flight bar of a can cartoning machine which supports the infeed pressure of the machine without causing cans which it contacts to be dented or creased.

BRIEF SUMMARY OF THE INVENTION

The apparatus of the present invention provides an article selector wedge for use with a cartoning machine. The wedge surface which contacts the articles is non planar. It works particularly well on cylindrical articles, such as beverage cans, that have thin walls which are easily deformed. In the preferred embodiment, the contact surface has a convex curvature which allows a thin wall of a cylindrical article to conform to it under infeeding loads without causing dents or creases in the wall. The preferred embodiment of the article selector wedge also has a recess for accepting an end of a flight bar, which is fixedly attached thereto by screws.

The features, benefits and objects of this invention will become clear to those skilled in the art by reference to the following description, claims and drawings.

DETAILED DESCRIPTION

Figure 1:
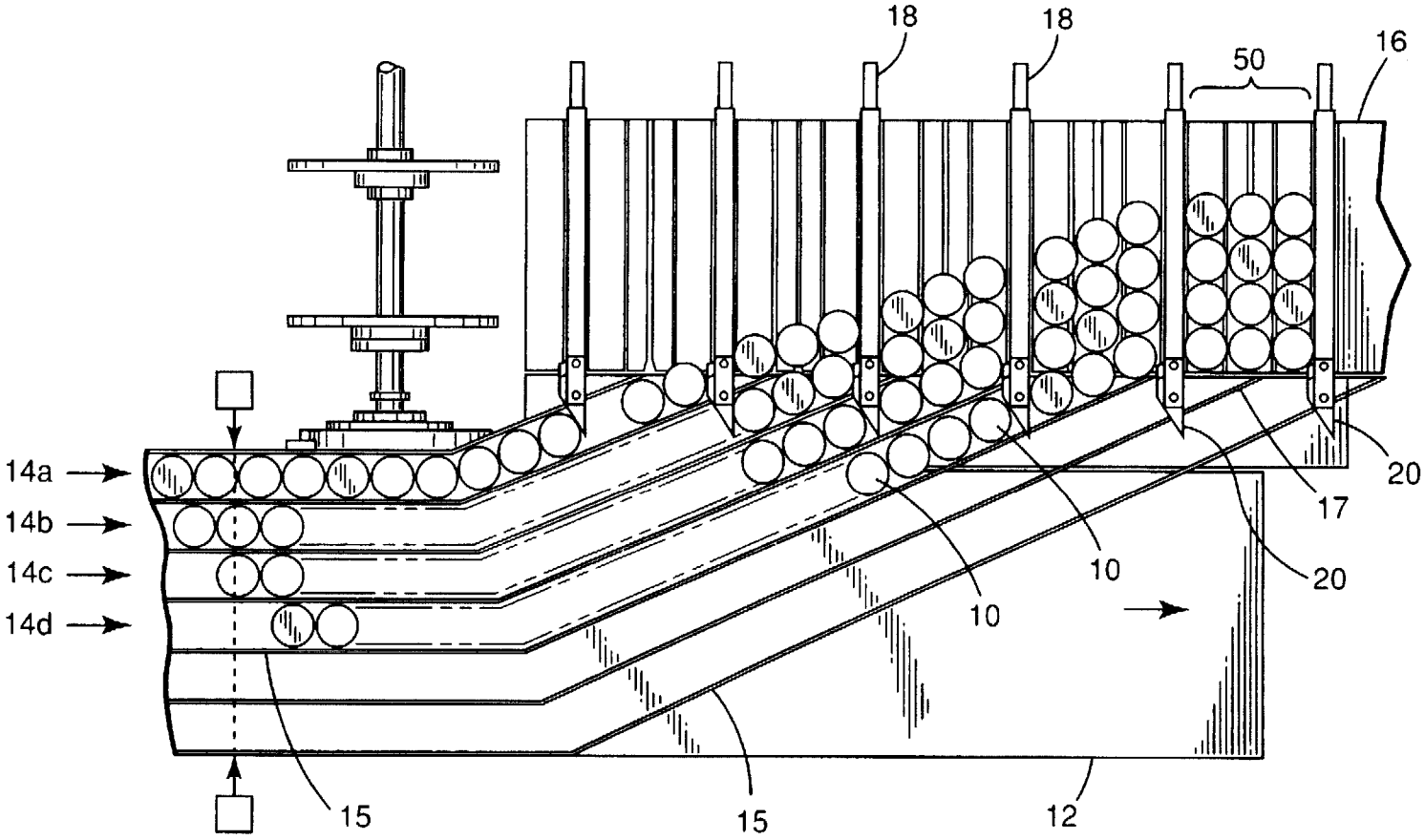
FIG. 1 is a top view of a can selection area of a packaging machine showing how can infeed lanes, conveyers, flight bars and can selector wedges function to select and separate cans into groups.
Figure 2:
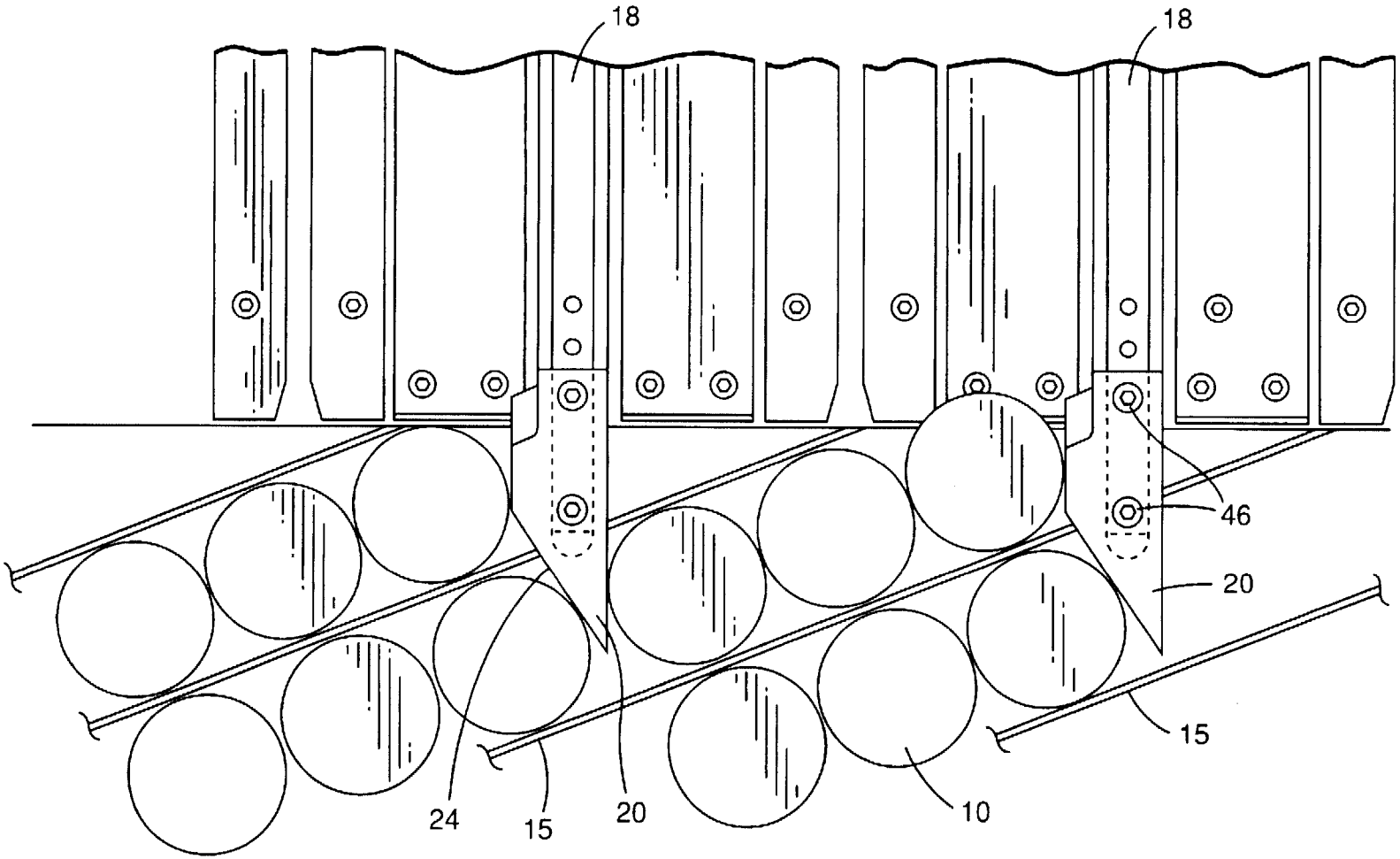
FIG. 2 is top view of a portion of the can selection area of a packaging machine showing how can selector wedges are attached to flight bars and how can selector wedges function to select and separate cans into groups.
Figure 3:
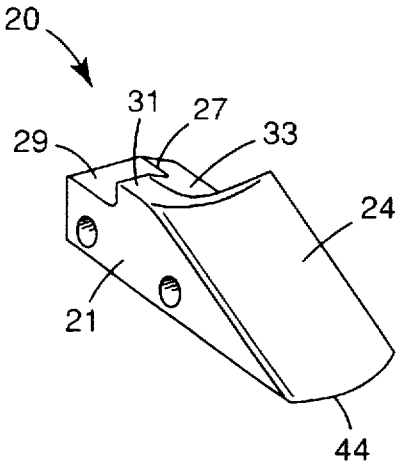
FIG. 3 is a perspective view of a can selector wedge of the present invention.

The wedge of the present invention is well suited for use on a machine for cartoning beverage cans as described in U.S. Pat. No. 5,456,058 to Ziegler, which is hereby incorporated by reference. Referring to FIGS. 1 and 2, many cartoning machines have a selecting system as shown. Cans 10 move on an infeed conveyer 12 in lanes 14. The lanes 14 direct the cans 10 at an angle toward another conveyer 16 having flight bars 18 with selector wedges 20 attached. As conveyer 16 with flight bars 18 meets a stream of cans 10, the selector wedge 20 on each flight bar 18 nudges between the cans 10, thereby allowing the flight bars 18 to separate the cans 10 into groups 50. The size, orientation, and dimensions of groups 50 depends on the number of lanes 14, product dimensions, and the configuration and spacing of flight bars 18 on conveyor 16. In the example illustrated in FIG. 1, four lanes 14*a*–14*d* are used and flight bars 18 are spaced to select three cans in each lane to form rectangular groups 50 of 12 cans having a 4 by 3 configuration.

Lanes 14 have lane separator walls 15 which must allow wedges 20 on flight bars 18 to pass through them. In the preferred embodiment this is accomplished by lane separator walls 15 having slots (not shown) at end 17 near conveyor 16 wide enough to allow wedges 20 to pass through them.

Because the infeed conveyor 12 runs faster than conveyer 16 with flight bars 18, there is significant pressure from infeeding cans 10 on the can selector wedges 20 when wedges 20 select and separate cans 10 into groups. The back pressure from the entire can mass in a lane 14 rests against face 24 of a wedge 20. That pressure causes a can 10 in contact with a wedge 20 to compress where it contacts the wedge. Sometimes the pressure is so great that cans are dented or creased where they contact a selector wedge.

The problem is related to the shape of the surface of the wedge where it contacts a can. On prior art wedges, face 24 which interfaces with cans 10 is planar. Because a can is cylindrical, to compress it laterally without causing a permanent deformation such as a dent or crease requires that the surface area of the compressed region not change during compression. A flat wedge face does not promote this. When a flat face compresses a cylindrical can, it tries to make a planar impression on the can wall. That planar impression has a smaller surface area than the corresponding surface area of the cylinder. The result is that the affected area of the can wall may be highly stressed enough for local buckling to occur - i.e. dents and creases.

Observation of damaged cans indicated that most of the damage occurs near the edges of a flat-faced wedge. This is consistent with the theory set forth above since the maximum bending loads are induced at that location where the maximum load change occurs.

In the first attempt to solve the problem, only the edges of the planar wedge face were radiused. This did not significantly improve the problem because most of the contact surface was still flat.

The present invention solves the problem by providing an outwardly curved surface 24 on wedge 20. With this wedge, a portion of the outwardly curved can wall may curve inwardly without changing the surface area. Bench testing of a wedge of the present invention allowed both round and fluted cans to be compressed nearly ⅛ inch without visible damage. This compares favorably to cans which showed visible damage after being compressed only 1/16 inch using a conventional flat-faced wedge.

Referring to FIGS. 3 through 6, the can selector wedge 20 of the present invention comprises a wedge shaped body having a first face 22 and an opposing second face 24, which is non-planar. There is an acute angle θ between the two faces 22 and 24. Face 24 reacts the infeed pressure of a lane of cans. In the preferred embodiment, face 22 is planar, angle θ is approximately 30° and face 24 has a cylindrical outwardly curved surface with a radius of approximately 3 inches, the curvature being in the lateral direction of face 24. Face 24 may also have a series of facets or other such features which together approximate a curved surface. The 30° angle between face 22 and 24 allows face 24 to be normal to lane separator walls 15 at end 17. The reaction of infeed pressure on cans 10 is, therefore, in the same direction as the cans 10 move so as to not induce a side load on a can 10 which contacts wedge 20 which could increase friction between that can and lane separator walls 15.

Edge 44 is formed by the intersection of face 24 and face 22. In the preferred embodiment edge 44 is curved. As the radius of face 24 decreases, so does the radius of edge 44. Edge 44 makes first contact with cans 10. If the radius of edge 44 is too small, that first contact is over too small an area which could damage the can making contact. The 3 inch radius on face 24 provides enough curvature to face 24 to prevent damage to thin walled cans from infeed pressure, yet the radius of edge 44 is still large enough to allow sufficient contact area to not damage can on first contact. All outside edges other than edge 44 are radiused, preferably ⅛ inch, and intersecting radii are blended.

In the preferred embodiment, can selector wedge 20 is a solid body having, in addition to face 22 and face 24, a first side 21, a second side 23, a back side 25, and a third surface 27 opposite face 22. Third surface 27 has a portion 29 adjacent to back side 25 and a portion 31 adjacent to face 24. Portion 29 and portion 31 are substantially planar and parallel to face 22, and portion 31 is disposed from portion 29 away from face 22 to form a step in third surface 27. Portion 29 aligns with flight bar 18 so there is no step between wedge 20 and flight bar 18 so cans can flow smoothly over wedge 20 onto flight bar 18. A group of cans can fill the full length of a flight bar and extend onto portion 29. Portion 31 is stepped from portion 29 to allow face 24 to be long enough to have sufficient contact distance as wedge moves between cans.

Third surface 27 also has a beveled portion 33 which is beveled laterally toward side 23 and intersects portions 29 and 31. Beveled portion 33 is necessary when wedge 20 is used on a machine which groups more than one level of cans into a stack and packages the stack. A paperboard divider sheet is inserted in the stack between levels of cans. Beveled portion 33 is necessary to allow the divider sheet to pass over wedge 20 when the divider sheet is installed.

Figure 4:
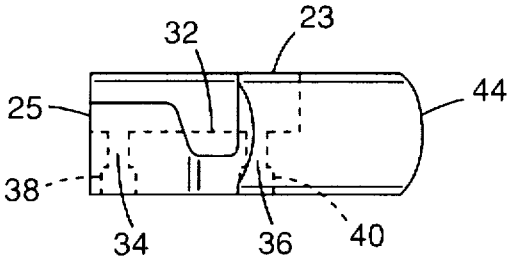
FIG. 4 is a top view of the can selector wedge of FIG. 3.
Figure 6:
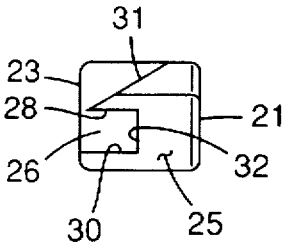
FIG. 6 is a rear end view of the can selector wedge of FIG. 3.
Figure 5:
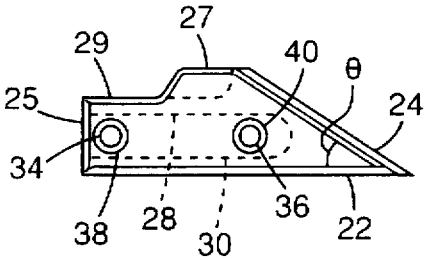
FIG. 5 is a side view of the can selector wedge of FIG. 3.

Referring to FIGS. 2, 4, and 5, in the preferred embodiment, wedge 20 also has a recess 26 bounded by surfaces 28, 30, and 32 for receiving an end of a flight bar 18. An attachment means fixedly connects wedge 20 to a flight bar 18 of a selecting system (not shown). In the preferred embodiment the attachment means is a pair of cap screws 46 which engage flight bar 18 after passing through holes 34 and 36 having counter bores 38 and 40.

Figure 7:
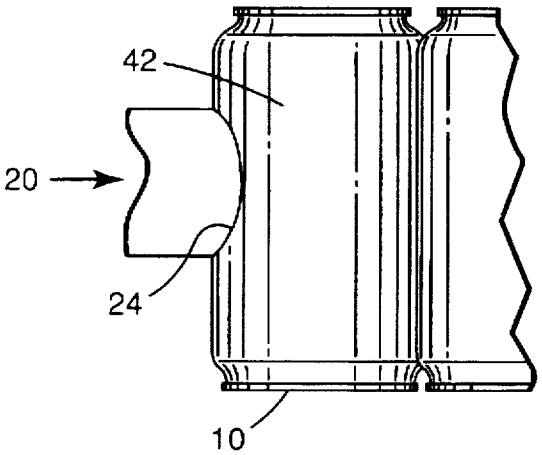
FIG. 7 is a view of a can selector wedge of the present invention in contact with a can.

Referring to FIG. 7, the can selector wedge 20 of the present invention is shown in contact with a can 10. Face 24 of can selector wedge 20 interfaces with the cylindrical wall 42 of can 10 causing wall 42 to deform in compliance with face 24 of can selector wedge 20. Under loads typical of those caused by an infeed mechanism of a can cartoning machine, the curvature of face 24 of can selector wedge 20 allows wall 42 of can 10 can to deform to face 24 without denting or creasing.

The material for can selector wedge 20 can be any rigid material. In the preferred embodiment it is a plastic having the trade name DELRIN.

The descriptions above and the accompanying drawings should be interpreted in the illustrative and not the limited sense. While the invention has been disclosed in connection with the preferred embodiment thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A selector wedge for selecting and forming groups of thin-walled, cylindrical articles traveling from an upstream end to a downstream end on an infeed mechanism, said selector wedge comprising: a body having an anterior end, a posterior end opposite said anterior end, a generally vertical first face and a generally vertical second face intersecting at said anterior end and forming an acute angle between said first face and said second face, said first face having an outwardly curving surface for contacting the articles on the infeed mechanism, said first face being oriented toward the upstream end of the infeed mechanism, wherein pressure exerted by an article in contact with said first face causes a portion of the article to temporarily conform to said outwardly curving surface, whereby said outwardly curving surface allows the article to withstand, without damage, greater pressure between the article and said wedge, whereby the greater pressure is caused by a higher relative velocity between the article traveling on the infeed mechanism and said wedge, and whereby the higher relative velocity corresponds with a faster article group selection and formation process.

2. The selector wedge of claim 1 wherein said first face and said second face form a curved edge at said anterior end common to both said first face and said second face.

3. The selector wedge of claim 1 wherein said first face has a generally horizontal top edge and a generally horizontal bottom edge, said top edge being parallel to said bottom edge, wherein said second face has a generally horizontal top edge and a generally horizontal bottom edge, said top edge being parallel to said bottom edge, and wherein said body further has a generally horizontal first side, a generally horizontal second side, and a back side, said first side extending from said bottom edge of said first face to said bottom edge of said second face, said second side extending from said top edge of said first face to said top edge of said second face, said back side being located at said posterior end of said body and having edges which meet said second face, said first side, and said second side.

4. The selector wedge of claim 3 wherein said body has a recess on said second side, said recess extending through said back side and having a shape to receive an end of a powered flight bar.

5. The selector wedge of claim 4 wherein said body has at least one aperture extending from said first side through said body to said recess, and wherein said body is fastened to the end of the flight bar through said at least one aperture.

6. The selector wedge of claim 5 wherein a portion of said at least one aperture has a counterbore at said first side.

7. The selector wedge of claim 3 wherein said body further has a third surface located opposite said second face, said third surface extending from said back side to said first face and extending from said first side to said second side.

8. The selector wedge of claim 7 wherein said third surface has an anterior portion and a posterior portion both of which are substantially planar and parallel to said second face, said posterior portion being disposed from said anterior portion toward said second face.

9. The selector wedge of claim 7 wherein said third surface as a lateral portion beveled toward said second side.

10. The selector wedge of claim 7 wherein said third surface has an anterior portion, a posterior portion, and a lateral portion, said anterior and posterior portions being substantially planar and parallel to said second face, said posterior portion being disposed from said anterior portion toward said second face, said lateral portion being beveled in a direction toward said second side, said lateral portion intersecting said anterior and said posterior portions.

11. The selector wedge of claim 1 wherein:

a) said first face and said second face form a curved edge at said anterior end common to both said first face and said second face;

b) said first face has a generally horizontal top edge and a generally horizontal bottom edge, said top edge being parallel to said bottom edge, said second face has a generally horizontal top edge and a generally horizontal bottom edge, said top edge being parallel to said bottom edge, said body further has a generally horizontal first side, a generally horizontal second side, and a back side, said first side extending from said bottom edge of said first face to said bottom edge of said second face, said second side extending from said top edge of said first face to said top edge of said second face, said back side being located at said posterior end of said body and having edges which meet said second face, said first side, and said second side;

c) said body has a recess on said second side, said recess extending through said back side and having a shape to receive an end of a powered flight bar;

d) said body has at least one aperture extending from said first side through said body to said recess, a portion of said at least one aperture having a counterbore at said first side; and e) said body has a third surface located opposite said second face, said third surface extending from said back side to said first face and extending from said first side to said second side, said third surface having an anterior portion, a posterior portion, and a lateral portion, said anterior and posterior portions being substantially planar and parallel to said second face, said posterior portion being disposed from said anterior portion toward said second face, said lateral portion being beveled in a direction toward said second edge, said lateral portion intersecting said anterior and said posterior portions.

12. The selector wedge of claim 1 further comprising means for moving said body.

13. The selector wedge of claim 12 wherein said means for moving is a powered flight bar.

14. The selector wedge of claim 12 further comprising a means for attaching said body to said means for moving said body.

15. The selector wedge of claim 1 wherein the cylindrical objects are beverage cans.

16. A selector wedge for selecting thin-walled, cylindrical, aluminum beverage cans traveling on a high-speed infeed mechanism, said selector wedge comprising:

(a) a body having an anterior end, a posterior end opposite said anterior end, a generally vertical first face, a generally vertical second face, a generally horizontal first side, a generally horizontal second side, and a generally vertical back side, said first face and said second face intersecting at said anterior end and forming both an acute angle and an edge common to both said first face and said second face, said first face having an outwardly curving surface, wherein said first face causes a portion of a can in contact with said wedge to temporarily conform to the shape of the outwardly curving surface, whereby the can withstands, without damage, greater pressure between the can and said wedge, whereby the greater pressure is caused by a higher relative velocity between the can traveling on the high-speed infeed mechanism and said wedge, said first face further having a generally horizontal top edge and a generally horizontal bottom edge, said top edge being parallel to said bottom edge, said second face having a generally horizontal top edge and a generally horizontal bottom edge, said top edge being parallel to said bottom edge, said first side extending from said bottom edge of said first face to said bottom edge of said second face, said second side extending from said top edge of said first face to said top edge of said second face, said back side being located at said posterior end of said body and having edges which meet said second face, said first side, and said second side; said body further having a recess on said second side, said recess extending through said back side, said body further having at least one aperture extending from said first side through said body to said recess, a portion of said at least one aperture having a counterbore at said first side; said body further having a third surface located opposite said second face, said third surface extending from said back side to said first face and extending from said first side to said second side, said third surface having an anterior portion, a posterior portion, and a lateral portion, said anterior and posterior portions being substantially planar and parallel to said second face, said posterior portion being disposed from said anterior portion toward said second face, said lateral portion being beveled in a direction toward said second edge, said lateral portion intersecting said anterior and said posterior portions;

(b) a powered flight bar for moving said body; and (c) means for attaching said body to said powered flight bar.

17. A system for selecting groups of cylindrical articles on a packaging machine comprising:

(a) a plurality of selector wedges, each selector wedge having an anterior end, a posterior end opposite said anterior end, a generally vertical first face and a generally vertical second face with an acute angle between said first face and said second face at said anterior end, said first face having an outwardly curving surface;

(b) a plurality of moving flight bars, each of said flight bars having one of said selector wedges attached to it;

(c) an infeed mechanism; and (d) lanes for directing said cylindrical articles traveling on said infeed mechanism toward said moving flight bars, said lanes allowing said moving flight bars with said selector wedges to pass through said lanes;

wherein said infeed mechanism feeds said cylindrical articles into said lanes which guide said cylindrical articles into said moving flight bars, wherein said selector wedge is nudged between cylindrical articles to form groups of articles, and wherein, as said selector wedge contacts said cylindrical articles, pressure exerted against said cylindrical articles in said lanes causes a portion of said a cylindrical article in contact with said first face of said selector wedge to conform to said outwardly curving surface of said first face, whereby said outwardly curving surface allows the article to withstand, without damage, greater pressure between the article and said wedge, whereby the greater pressure is caused by a higher relative velocity between the article traveling on said infeed mechanism and said wedge, and whereby the higher relative velocity corresponds with a faster article group selection process.

18. A system for selecting groups cylindrical articles on a packaging machine comprising:

(a) a plurality of selector wedges, each selector wedge having a body, said body having an anterior end, a posterior end opposite said anterior end, a generally vertical first face, a generally vertical second face, a generally horizontal first side, a generally horizontal second side, and a generally vertical back side, said first face and said second face intersecting at said anterior end and forming both an acute angle and an edge common to both said first face and said second face, said first face having an outwardly curving surface, wherein said first face causes a portion of an article in contact with said wedge to temporarily conform to the shape of the outwardly curving surface, said first face further having a generally horizontal top edge and a generally horizontal bottom edge, said top edge being parallel to said bottom edge, said second face having a generally horizontal top edge and a generally horizontal bottom edge, said top edge being parallel to said bottom edge, said first side extending from said bottom edge of said first face to said bottom edge of said second face, said second side extending from said top edge of said first face to said top edge of said second face, said back side being located at said posterior end of said body and having edges which meet said second face, said first side, and said second side; said body further having a recess on said second side, said recess extending through said back side, said body further having at least one aperture extending from said first side through said body to said recess, a portion of said at least one aperture having a counterbore at said first side; said body further having a third surface located opposite said second face, said third surface extending from said back side to said first face and extending from said first side to said second side, said third surface having an anterior portion, a posterior portion, and a lateral portion, said anterior and posterior portions being substantially planar and parallel to said second face, said posterior portion being disposed from said anterior portion toward said second face, said lateral portion being beveled in a direction toward said second edge, said lateral portion intersecting said anterior and said posterior portions;

(b) a plurality of moving flight bars, each of said flight bars having one of said selector wedges attached to it;

(c) an infeed mechanism; and (d) lanes for directing said cylindrical articles traveling on said infeed mechanism toward said moving flight bars, said lanes allowing said moving flight bars with said selector wedges to pass through said lanes;

wherein said infeed mechanism feeds the cylindrical articles into said lanes which guide the cylindrical articles into said moving flight bars, wherein said selector wedge is nudged between the cylindrical articles to form groups of articles, and wherein, as said selector wedge contacts the cylindrical articles, pressure exerted against the cylindrical articles in said lanes causes a portion of a cylindrical article in contact with said first face of said selector wedge to conform to said outwardly curving surface of said first face, whereby said outwardly curving surface of said first face allows the cylindrical article to withstand, without damage, greater pressure between the cylindrical article and said wedge, whereby the greater pressure is caused by a higher relative velocity between the cylindrical article traveling on the infeed mechanism and said wedge, and whereby the higher relative velocity corresponds to a faster system for selecting groups of cylindrical articles.

* * * * *